US006432874B1

(12) United States Patent
Fukuchi et al.

(10) Patent No.: US 6,432,874 B1
(45) Date of Patent: Aug. 13, 2002

(54) THERMALLY SENSITIVE RECORDING MEDIUM

(75) Inventors: Tadakazu Fukuchi; Kaoru Hamada; Kunio Takebayashi; Hidenori Ogawa; Yoshimi Midorikawa; Reiko Sato; Yoshihide Kimura, all of Shinjuku-ku (JP)

(73) Assignee: Nippon Paper Industries Co, Ltd, Tokyo (JP)

( * ) Notice: Subject to any disclaimer, the term of this patent is extended or adjusted under 35 U.S.C. 154(b) by 0 days.

(21) Appl. No.: 09/572,088

(22) Filed: May 17, 2000

(30) Foreign Application Priority Data

May 21, 1999 (JP) ..... 11-141364

(51) Int. Cl.[7] ..... B41M 5/40
(52) U.S. Cl. ..... 503/200; 503/214; 503/226
(58) Field of Search ..... 427/152; 503/200, 503/226, 214

(56) References Cited

U.S. PATENT DOCUMENTS 5,173,472 A 12/1992 Mito et al. ..... 503/214

FOREIGN PATENT DOCUMENTS

| | | |
|---|---|---|
| EP | 0355012 | 2/1990 |
| EP | 0474122 | 3/1992 |

OTHER PUBLICATIONS

Japanese Patent Laid Open Publication 06–048036 (Abstract) Feb. 22, 1994.
Japanese Patent Laid Open Publication 08–324115 (Abstract) Dec. 10, 1996.
Japanese Patent Laid Open Publication 10–217608 (Abstract) Aug. 18, 1998.

*Primary Examiner*—Bruce H. Hess
(74) *Attorney, Agent, or Firm*—Sherman & Shalloway

(57) ABSTRACT

A thermally sensitive recording paper having a recording surface which when a postage stamp or a revenue stamp is adhered to the recording surface requires at least ten cycles of a removal test procedure to remove at least one third of the adhered surface of the stamp from the recording surface of the thermally sensitive recording paper, wherein the removal test procedure comprises adhering the postage stamp or revenue stamp to the recording surface of the thermally sensitive recording paper, hanging the recording paper over an iron bar of about 8 mm diameter with the postage stamp or revenue stamp on an outer surface of the recording paper, adjusting the recording paper such that equal lengths are on either side of the iron bar, attaching to one end of the thermally sensitive recording paper a weight of about 500 g, holding the other end of the thermally sensitive recording paper by hand and carrying out a pull down ant put back cycle motion of the hand to move the postage stamp or revenue stamp over the iron bar until at least a portion of the postage stamp or revenue stamp is removed from the surface of the recording paper.

4 Claims, 1 Drawing Sheet

THERMALLY SENSITIVE RECORDING MEDIUM

BACKGROUND OF THE INVENTION

1. Field of the Invention

Figure 1:
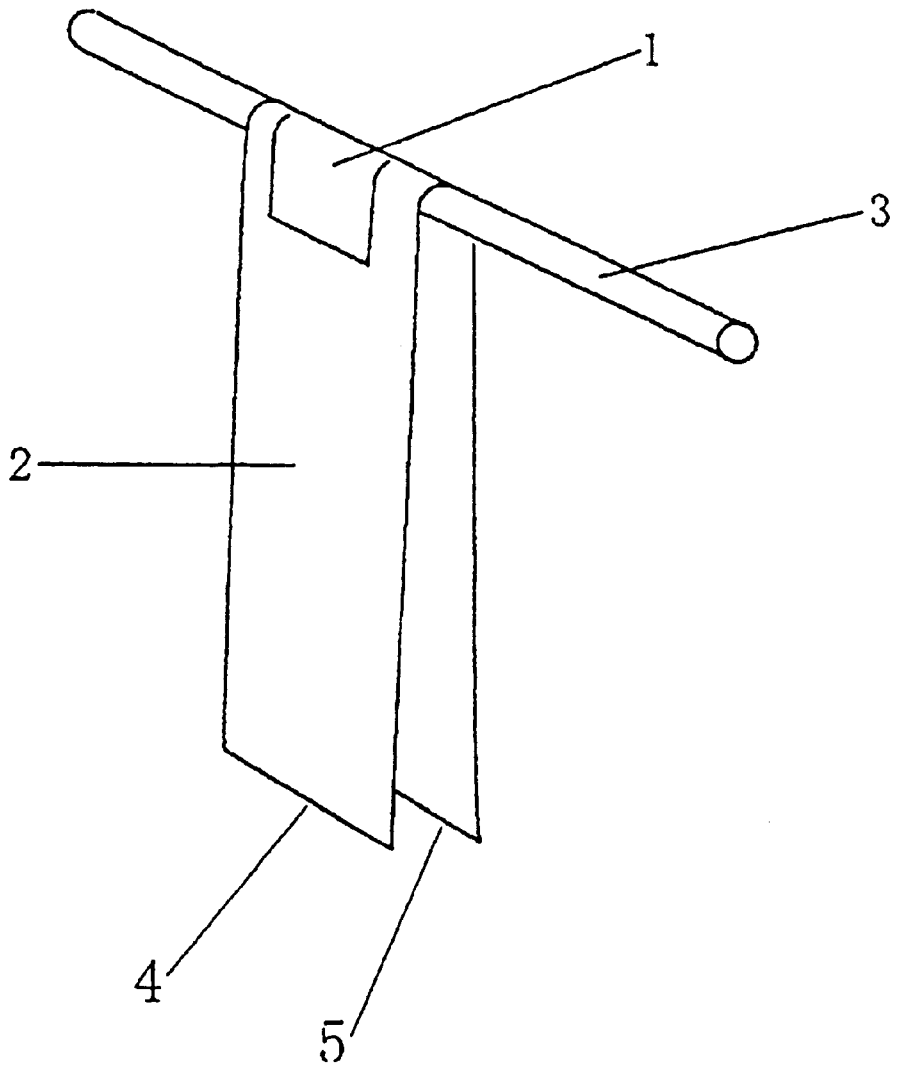

The present invention relates to a thermally sensitive recording paper that is good at adherent property to a postage stamp or a revenue stamp.

2. Description of the Prior Art

In general, a thermally sensitive recording paper having a thermally sensitive color developing layer mainly composed of colorless or pale colored basic dye and color developer that develops color by reacting with said basic dye when heated, is disclosed in Japanese Patent Publication 45-14039 and is widely used in the commercial scale. A thermal printer in which a thermal head is installed is used for the recording method of said thermally sensitive recording paper. Since this kind of thermal recording method superiors to a conventional recording method from the viewpoints of noiseless at recording process, does not need developing and fixing processes, maintenance free, equipment is relatively cheap and compact and the obtained image is very clear, therefore, this method is widely applied in the field of facsimile or computer, various kinds of measuring instrument and for a labeling machine along with the growth of an information industry.

Recently, the use of a thermally sensitive recording paper for a printing paper of a cash resister is becoming more popular and in many cases a printed-paper by a cash resister is used as a receipt. When a printed-paper by a cash resister is used as a receipt, a revenue stamp is adhered over the surface. Therefore, the requirement to improve the adherent property of a thermally sensitive recording paper to revenue stamp is becoming more severe, namely the adhered stamp must not be removed easily. And the thermally sensitive recording paper having above-mentioned property can be used as a post card, because an adhered postage stamp is not easily removed. However, compared with the normal paper, the adherent property to a postage stamp or a revenue stamp of conventional thermally sensitive recording paper is not so strong, and is easily removed after adhered.

The object of the present invention is to solve the above-mentioned problem that the conventional thermally sensitive recording paper has, and to provide a thermally sensitive recording paper whose adherent property to a revenue stamp or a postage stamp (hereinafter shortened to revenue stamp adaptability) is improved.

BRIEF ILLUSTRATION OF THE INVENTION

The invention disclosed in claim 1 is a thermally sensitive recording paper having a recording surface which when a postage stamp or a revenue stamp is adhered to the recording surface requires at least ten cycles of a removal test procedure to remove at least one third of the adhered surface of the stamp from the recording surface of the thermally sensitive recording paper, wherein the removal test procedure comprises adhering the postage stamp or revenue stamp to the recording surface of the thermally sensitive recording paper, hanging the recording paper over an iron bar of about 8 mm diameter with the postage stamp or revenue stamp on an outer surface of the recording paper, adjusting the recording paper such that equal lengths are on either side of the iron bar, attaching to one end of the thermally sensitive recording paper a weight of about 500 g, holding the other end of the thermally sensitive recording paper by hand and carrying out a pull down ant put back cycle motion of the hand to move the postage stamp or revenue stamp over the iron bar until at least a portion of the postage stamp or revenue stamp is removed from the surface of the recording paper.

In the present invention, the cycles of a removal test procedure to remove at least one third of the adhered surface of the revenue stamp or postage stamp from the recording surface of the thermally sensitive recording paper is an index that indicates adherent degree of adhered revenue stamp or postage stamp. Therefore, if the number of cycles is large, the revenue stamp adaptability is good. And in the present invention, when the number of cycles is over 10 times, the sufficient revenue stamp adaptability can be obtained. Further, when the number of cycles is over 30 times, desirable effect can be obtained and when the number of cycles is over 50 times, more desirable effect can be obtained. On the contrary, when number of cycles is below 10 times, the adhered revenue stamp is easily removed and a thermally sensitive recording paper that has necessary revenue stamp adaptability can not be obtained.

The invention of claim 2 is a thermally sensitive recording paper possessing a middle layer and a thermally sensitive recording layer containing colorless or pale colored basic basic dye and color developer that develops color by reacting with said basic basic dye on a substrate, wherein at least a middle layer between a middle layer and a thermally sensitive recording layer contains polyvinyl alcohol or denatured polyvinyl alcohol whose degree of polymerization is bigger than 450 and degree of saponification is smaller than 90%. When the measuring method disclosed in claim 1 is made on the thermally sensitive recording paper of claim 2, the repeating numbers necessary to remove more than one third of adhered surface area of a revenue stamp becomes over than 10 times.

That is, the inventors of this invention have aimed at a middle layer and have found that the use of polyvinyl alcohol or denatured polyvinyl alcohol whose degree of polymerization is bigger than 450 and degree of saponification is smaller than 90% can improve the revenue stamp adaptability, and have accomplished the invention of claim 2. The inventors of this invention have already found that the revenue stamp adaptability of the thermally sensitive recording paper having a middle layer between a substrate and a thermally sensitive layer is inferior to that of the thermally sensitive recording paper not having a middle layer. The reason why can be considered as follow. That is, usually, a middle layer is prepared for the purpose to improve the color developing sensitivity, therefore the adiabatic property is needed. To satisfy the requirement for high adiabatic property, the porosity of this layer becomes very high. When a revenue stamp is adhered, water stuck to the glue surface of stamp penetrates through the thermally sensitive recording layer and reaches to the middle layer. By the effect of penetrated water, the bonding strength of middle layer is weakened and cracked, then the adhered stamp is removed from the substrate at the crack. Otherwise, it is considered that by the effect of penetrated water, sticking force between middle layer and substrate is weakened, and adhered stamp is removed at the boundary of middle layer and substrate.

A middle layer mainly contains inorganic or organic dye and binder, and as the binder, water-soluble polymer such as polyvinyl alcohol is well known. The type of polyvinyl alcohol used in this invention is the same type that acts usually as a dispersing agent or a bonding agent at the formation of a thermally sensitive recording layer or a protecting layer. Therefore, a lower water-soluble polyvinyl alcohol, that is, full saponificated polyvinyl alcohol whose degree of saponification is high is preferably used. The degree of saponification of polyvinyl alcohol used in general is bigger than 98%. In the meanwhile, since partially saponificated polyvinyl alcohol whose degree of saponification is low has a problem to hinder the color developing ability, it can not be actually used. However, in the present invention, water solubility is improved by containing polyvinyl alcohol whose degree of saponification is lower than 90% or denatured polyvinyl alcohol and can absorb water simultaneously, therefore, adhesive component penetrates into a middle layer with water, and adhere with a revenue stamp strongly after dried up.

Meanwhile, as the conventionally used polyvinyl alcohol, polyvinyl alcohol of lower viscosity, that is, whose degree of polymerization is low is preferably used from the viewpoint of a good dispersing agent or a coating adaptability. On the contrary, it is concerned that the adhering strength of a revenue stamp with adhesive component is improved by containing polyvinyl alcohol or denatured polyvinyl alcohol whose degree of polymerization is bigger than 450. Especially, it is desirable that the degree of polymerization of said polyvinyl alcohol is bigger than 1000. The excellent revenue stamp adaptability can be accomplished by degree of polymerization from 450 to 1000. And, when more strong adhering ability is required, it is effective to use polyvinyl alcohol whose degree of polymerization is bigger than 1000.

It is desirable to contain 1.5–20 weight % of polyvinyl alcohol or denatured polyvinyl alcohol whose degree of polymerization is bigger than 450 and degree of saponification is smaller than 90% to the total solid weight of middle layer. By containing said polyvinyl alcohol by mentioned ratio, excellent revenue stamp adaptability can be obtained. The influence of polyvinyl alcohol to the color developing ability is not so serious because it is contained in a middle layer, but in this invention, the influence of it is more effectively prevented.

In the present invention, polyvinyl alcohol or denatured polyvinyl alcohol whose degree of polymerization is bigger than 450 and degree of saponification is smaller than 90% can be also contained in a thermally sensitive recording layer. Also in this case, the desirable degree of polymerization is bigger than 1000 and the desirable containing ratio is 1.5–10% by weight to the total solid weight of the thermally sensitive recording layer concerning an obstruction to the color developing ability. When the content of polyvinyl alcohol or denatured polyvinyl alcohol whose degree of polymerization is bigger than 450 and degree of saponification is smaller than 90% is too small, the desired revenue stamp adaptability can not be obtained, and when said content is too big, the problem not only obstruction of color developing ability but also deterioration of water proof causes because the solubility to water becomes strong.

The invention of claim 3 is the thermally sensitive recording paper that contains pigment whose oil-absorbing amount is smaller than 100 ml/100 g. When the oil-absorbing ratio of pigment is large, polyvinyl alcohol or denatured polyvinyl alcohol whose degree of polymerization is bigger than 450 and degree of saponification is smaller than 90% is also absorbed and the desired effect to adhering ability with a revenue stamp can not be displayed clearly. In this invention, by containing pigment whose oil-absorbing amount is smaller than 100 ml/100 g, the absorbing amount of these polyvinyl alcohols to pigment can be reduced, and the excellent adhering strength to a revenue stamp can be obtained.

BRIEF ILLUSTRATION OF THE DRAWING

FIG. 1 shows the measuring test method of removing of adhered stamp from the thermally sensitive recording paper of claim 1. In the drawing, each numerical marks Illustrates;

1. revenue stamp or postage stamp
2. thermally sensitive recording paper
3. iron bar of 8 mm diameter
4. 5. end parts

DETAILED DESCRIPTION OF THE INVENTION

FIG. 1 displays the removing test of this invention. At the removing test, as the first step, the amount of water supplied to adhering surface of a revenue stamp or postage stamp 1 (hereinafter shortened to revenue stamp) is adjusted to 5.5±1.5mg and revenue stamp 1 is adhered to the recording surface of a thermally sensitive recording layer and pressed by a weight of 500 g for 3 minutes and then left for another 30 minutes. Then, said thermally sensitive recording paper 2 is hung up to an iron bar 3 with the revenue stamp on an outer surface. And, to the one end 4 or 5 of the thermally sensitive recording paper the weight of 500 g is hung down and to the other end is held by hand and rub the portion where a revenue stamp is adhered by cycle motion caused by pull down and put back action by hand. The number of cycles required to remove at least one third of adhered surface area of a revenue stamp are measured. The cycle motion is carried out one time by every 2 seconds. As an iron bar used in the removing test of this invention, the iron bar of 8 mm diameter is used, which has adequate length and the surface of which is not processed.

The preparation method of a thermally sensitive recording paper of this invention is illustrated as follows. Usually, a thermally sensitive recording paper is prepared by following process. That is, colorless or pale colored basic dye and color developer are respectively dispersed with binder, an additives such as pigment, sensitizer, ultra violet ray absorbing agent, water proof agent or defoamer are added at need, and the coating is prepared. The prepared coating is coated on a substrate and dried up, thus the thermally sensitive recording paper is prepared.

To a middle layer or a thermally sensitive recording layer of this invention, besides polyvinyl alcohol or denatured polyvinyl alcohol whose degree of polymerization is bigger than 450 and degree of saponification is smaller than 90%, a binder conventionally used in the field of thermally sensitive recording paper can be used. For example, full saponificated polyvinyl alcohol of 200–1900 polymerization degree, partial saponificated polyvinyl alcohol, denatured polyvinyl alcohol such as carboxyl denatured polyvinyl alcohol, amide denatured polyvinyl alcohol, sulfonic acid denatured polyvinyl alcohol or butylal denatured polyvinyl alcohol, derivatives of cellulose such as hydroxyethyl cellulose, methyl cellulose, ethyl cellulose, carboxymethyl cellulose or acetyl cellulose, copolymer of styrene-maleic anhydride, copolymer of styrene -butadiene, polyvinyl chloride, polyvinyl acetal, polyacrylicamide, polyacrylic acid ester, polyvinylbutylal, polystyrene or copolymer of them, polyamide resin, silicon resin, petroleum resin, terpene resin, ketone resin and cumarone resin can be mentioned. These macromolecule compounds can be applied by being dissolved into solvents such as water, alcohol, ketone, ester or hydrocarbon or by being dispersed in water or other medium under an emulsion state or a paste state and these forms of application can be used in combination according to the quality requirement.

As the binder for a thermally sensitive recording layer, an acrylic acid ester type resin can be used together with water soluble polymer. As the acrylic acid ester type resin, any kind of acrylic acid ester type resin can be used in the limit not to prevent the thermally sensitive recording feature and a revenue stamp adaptability. Concretely, (metha)acrylic acid ester, acrylic acid ester and/or copolymer composed of metacrylic acid ester and styrene and/or vinyl acetate, copolymer of acrylicamide/acrylic acid ester, copolymer of acrylicamide/acrylic acid/methacrylic acid, copolymer of colloidal silica complex acrylic acid ester and copolymer of colloidal silica complex styrene/acrylic acid ester can be mentioned, however, not intended to be limited to them.

When above mentioned binder is used together with polyvinyl alcohol or denatured polyvinyl alcohol whose degree of polymerization is bigger than 450 and degree of saponification is smaller than 90% at the preparation of a middle layer and a thermally sensitive recording layer, the mixing ratio or amount to be used can be decided according to the desired quality.

In a middle layer or a thermally sensitive recording layer of this invention, a conventional well-known organic or inorganic pigment can be contained. As the concrete example of such kind of pigment, an inorganic pigment such as alumina, magnesium hydroxide, calcium hydroxide, magnesium carbonate, zinc oxide, barium sulfate, silica, calcium carbonate, kaoline, calcined kaoline, diatomaceous earth, talc, titanium oxide or aluminum hydroxide, an organic pigment such as urea-formalin resin, styrene-metacrylic acid copolymer, polystyrene resin or amino resin filler, hollow plastic pigment or cup shape polymer particle disclosed in Japanese Patent Laid Open Publication 10-217608 or Japanese Patent Laid Open Publication 10-218950 can be mentioned. Among these pigments, as a pigment to be used in a middle layer, especially calcined kaoline and cup shape polymer particle disclosed in Japanese Patent Laid Open Publication 10-217608 or Japanese Patent Laid Open Publication 10-218950 are preferably used because of their good abiabatic ability. And, as a pigment to be used in a thermally sensitive recording layer, the pigment whose oil-absorbing amount is under 100 ml/100 g is effective for the good revenue stamp adaptability. These pigments can be used alone or can be used together with.

At the preparation of a middle layer or a thermally sensitive recording layer of this invention, a bridging agent of polymer substance can be added for the purpose to improve waterproof or image preservative ability. Any kind of conventional well-known bridging agent can be used in the limit not to prevent the thermally sensitive recording feature, and concretely dialdehyde type such as glyoxal or polyaldehyde, polyamine type such as polyethylamine, epoxy type, polyamide resin, melamine resin, diglycidyl type dimethylol urea, such as glycerin diglycidyl ether, ammonium persulfate, iron chloride and magnesium chloride can be mentioned, however, not intended to be limited to them.

In the present invention, as a slipping agent that is used in a middle layer or a thermally sensitive recording layer, any kind of conventional well-known slipping agent used for thermally sensitive recording paper can be used, and as a concrete example, metal salt of higher fatty acid such as zinc stearate or calcium stearate or wax such as paraffin wax, polyethylene wax, carnauba wax, microcrystalline wax or acrylic type wax can be mentioned. Especially, concerning a thermally head adaptability, zinc stearate or calcium stearate can be desirably used.

As a basic dye used in the thermally sensitive recording paper of this invention, all well-known dye in the field of conventional pressure sensitive type or thermally sensitive type recording paper can be used, and triphenyl methane type compound, fluoran type compound, fluorene type compound or divinyl type compound are desirably used, however, not intends to be limited to them. Typical examples of basic dye are mentioned below. Further, these basic dye can be used alone or together with.

<Triphenylmethane Type Basic Dyes>

3,3-bis(p-dimethylaminophenyl)-6-dimethylaminophthalide [another name is Crystal Violet Lactone]

3,3-bis(p-dimethylaminophenyl)phthalide [another name is Malachite Green Lactone]

<Fluoran Type Basic Dyes>

3-diethylamino-6-methylfluoran
3-diethylamino-6-methyl-7-anilinofluoran
3-diethylamino-6-methyl-7-(o, p-dimethylanilino)fluoran
3-diethylamino-6-methyl-7-chlorofluoran
3-diethylamino-6-methyl-7-(m-methylanilino)fluoran
3-diethylamino-6-methyl-7-(m-trifluoromethylanilino)fluoran
3-diethylamino-6-methyl-7-(o-chloroanilino)fluoran
3-diethylamino-6-methyl-7-(p-chloroanilino)fluoran
3-diethylamino-6-methyl-7-(o-fluoroanilino)fluoran
3-diethylamino-6-methyl-7-n-octylanilinofluoran
3-diethylamino-6-methyl-7-n-octylaminofluoran
3-diethylamino-6-methyl-7-benzylanilinofluoran
3-diethylamino-6-methyl-7-dibenzylanilinofluoran
3-diethylamino-6-chloro-7-methylfluoran
3-diethylamino-6-chloro-7-anilinofluoran
3-diethylamino-6-chloro-7-p-methylanilinofluoran
3-diethylamino-6-ethoxyethyl-7-anilinofluoran
3-diethylamino-7-methylfluoran
3-diethylamino-7-chlorofluoran
3-diethylamino-7-(m-trifluoromethylanilino)fluoran
3-diethylamino-7-(o-chloroanilino)fluoran
3-diethylamino-7-(p-chloroanilino)fluoran
3-diethylamino-7-(o-fluoroanilino)fluoran
3-diethylamino-benzo[a]fluoran
3-diethylamino-benzo[c]fluoran
3-dibutylamino-6-methyl-fluoran
3-dibutylamino-6-methyl-7-anilinofluoran
3-dibutylam ino-6-methyl-7-(o, p-dimethylanilino)fluoran
3-dibutylamino-6-methyl-7-(o-chloroanilino)fluoran
3-dibutylamino-6-methyl-7-(p-chloroanilino)fluoran
3-dibutylamino-6-methyl-7-(o-fluoroanilino)fluoran
3-dibutylamino-6-methyl-7-(m-trifluoromethylanilino)fluoran
3-dibutylamino-6-methyl-7-chlorofluoran
3-dibutylamino-6-ethoxyethyl-7-anlionofluoran
3-dibutylamino-6-chloro-7-anilinofluoran
3-dibutylamino-6-methyl-7-p-methylanilinofluoran
3-dibutylamino-7-(o-chloroanilino)fluoran
3-dibutylamino-7-(o-fluoroanilino)fluoran
3-di-n-pentylamino-6-methyl-7-anilinofluoran
3-di-n-pentylamino-6-methyl-7-(p-chloroaniino)fluoran
3-di-n-pentylamino-7-(m-trifoluoromethylaniiono)fluoran
3-di-n-pentylamino-6-chloro-7-anilinofluoran
3-di-n-pentylamino-7-(p-chloroanilino)fluoran
3-pyrrolidino-6-methyl-7-anilinofluoran
3-piperidino-6-methyl-7-anilinofluoran
3-(N-methyl-N-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran 3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-cyclohexylamino-6-chlorofluoran
2-(4-oxahexyl)-3-dimethylamino-6-methyl-7-anilinofluoran
2-(4-oxahexyl)-3-diethylamino-6-methyl-7-anilinofluoran
2-(4-oxahexyl)-3-dipropylamino-6-methyl-7-anilinofluoran
2-methyl-6-p-(p-dimethylaminophenyl)aminoanilinofluoran
2-methoxy-6-p-(p-dimethylaminophenyl) aminoanilinofluoran
2-chloro-3-methyl-6-p-(p-phenylaminophenyl) aminoanilinofluoran
2-chloro-6-p-(p-dimethylami nophenyl)aminoanilinofluoran
2-nitro-6-p-(p-diethylaminophenyl)aminoanilinofluoran
2-amino-6-p-(pdiethylaminophenyl)aminoanilinofluoran
2-diethylamino-6-p-(p-diethylaminophenyl) aminoanilinofluoran
2-phenyl-6-metyl-6p-(p-phenylaminophenyl) aminoanilinofluoran
2-benzy-6-p(p-phenylaminophenyl)aminoanilinofluoran
2-hydroxy-6-p-(p-phenylaminophenyl)aminoanilinofluoran
3-methyl-6-p-(p-dimethylaminophenyl)aminoanilinofluoran
3-diethylamino-6-p-(p-diethylaminophenyl) aminoanilinofluoran
3-diethylamino-6-p-(p-dibutylaminophenyl) aminoanilinofluoran
2,4-dimethyl-6-[(4-dimethylamino) anilino]-fluoran
<Fluorene type Basic Dyes>
3,6,6'-tris(dimethylamino)spiro[fluorene-9,3'-phthalide]
3,6, 6'-tris(diethylamino) spiro[fluorene-9,3'-phthalide]
<Divinyl Type Basic Dyes>
3,3-bis-[2-(p-dimethylaminophenyl)-2-(p-methoxyphenyl) ethenyl]-4,5,6,7-tetra bromophthalide
3,3-bis-[2-(p-dimethylaminophenyl)-2-(p-methoxyphenyl) ethenyl]-4,5,6,7-tetra chlorophthalide
3,3-bis-[1,1-bis(4-pyrrolidinophenyl)ethylen-2-yl]-4,5,6,7-tetrabromophthalide
3,3-bis-[1-(4-methoxyphenyl)-1-(4-pyrrolidinophenyl) ethylene-2-yl]-4,5,6,7-tetrachlorophthalide
<Others>
3-(4-diethylamino-2-ethoxyphenyl)-3-(1-ethyl-2-methylindol-3-yl)-4aza phthalide
3-(4-diethylamino-2-ethoxyphenyl)-3-(1-octyl-2-methylindol-3-yl)-4-aza phthalide
3-(4-cyclohexylethylamino-2-methoxyphenyl)-3-(1-ethyl-2-methylindol-3-yl)-4-azaphthalide
3,3-bis(1-ethyl-2-methylindol-3-yl)phthalide
3,6-bis(diethylamino)fluoran-γ-(3'-nitro)anilinolactam
3,6-bis(diethylamino)fluoran-γ-(4'-nitro)anilinolactam
1,1-bis-[2',2',2",2"-tetrakis-(p-dimethylaminophenyl)-ethenyl]-2,2-dinitrilethane
1,1-bis-[2',2',2",2"-tetrakis-(p-dimethylaminophenyl)-ethenyl]-2-β-naphthoyl ethane
1,1-bis-[2',2',2",2"-tetrakis-(p-dimethylaminophenyl)-ethenyl]-2,2-diacetylethane bis-[2,2,2',2'-tetrakis-(p-dimethylaminophenyl)-ethenyl]-methylmalonicacid dimethylester.

As the organic color developer used in the thermally sensitive recording paper of this invention, for instance, bisphenol A type disclosed in Japanese Patent Laid Open Publication 3-207688 and Japanese Patent Laid Open Publication 5-24366, 4-hydroxybenzoic acid ester type, 4-hydroxyphtalic acid diester type, phtalic acid monoester type, bis-(hydroxyphenyl)sulfide type, 4-hydroxyphenylarylsulphonate type, 1,3-di[hydroxyphenyl]-2-propyl]-benzene type and 4-hydroxybenzoyloxybenzoic acid ester type and bisphenol sulfone type can be mentioned. The typical examples of well-known color developer are mentioned below, however, not limited to them. These color developer can be used by mixing together with. Among these color developers, since heat resistance of 2,4'-sulfonyldiphenyl (another name is 2,4'-bisphenol S) is excellent, 2,4'-sulfonyidiphenyl is fitted to the use which requires heat resistance.

<Bisphenol A Type>
4,4'-isopropylidenediphenol (another name is bisphenol A)
4,4'-cyclohexylidenediphenol
p,p'-(1-methyl-n-hexylidene)diphenol
1,7-di(hydroxyphenylthio)-3,5-dioxaheptane
<4-Hydroxybenzoic Acid Ester Type>
4-hydroxybenzyl benzoate
4-hydroxyethyl benzoate
4-hydroxypropyl benzoate
4-hydroxyisopropyl benzoate
4-hydroxybutyl benzoate
4-hydroxyisobutyl benzoate
4-hydroxymethylbenzyl benzoate.
<4-Hydroxyphthalic Acid Diester Type>
4-hydroxydimethylphthalate
4-hydroxydiisopropylphthalate
4-hydroxydibenzylphthalate
4-hydroxydibenzylphthalate
<Phthalic Acid Monoester Type>
monobenzyl phthalate
monocyclohexyl phthalate
monophenyl phthalate
monomethylphenyl phthalate
monoethylphenyl phthalate
monopropylbenzyl phthalate
monohalogenbenzyl phthalate
monoethoxybenzyl phthalate
<Bis-(hydroxyphenyl)sulfide Type>
bis-(4-hydroxy-3-tert-butyl-6methylphenyl)sulfide
bis-(4-hydroxy-2,5-dimethylphenyl)sulfide
bis-(4-hydroxy-2-methyl-5-ethylphenyl)sulfide
bis-(4-hydroxy-2-methyl-5-isopropylphenyl)sulfide
bis-(4-hydroxy-2,3-dimethylphenyl)sulfide
bis-(4-hydroxy-2,5-dimethylphenyl)sulfide
bis-(4-hydroxy-2,5-diisopropylphenyl)sulfide
bis-(4-hydroxy-2,3,6-trimethylphenyl)sulfide
bis-(2,4,5-trihydroxyphenyl)sulfide
bis-(4-hydroxy-2-cyclohexyl-5-methylphenyl)sulfide
bis-(2,3,4-trihydroxyphenyl)sulfide
bis-(4,5-dihydroxy-2-tert-butylphenyl)sulfide
bis-(4-hydroxy-2,5-diphenylphenyl)sulfide
bis-(4-hydroxy-2-tert-octyl-5-methylphenyl)sulfide
<4-hydroxyphenylarylsulfone Type>
4-hydroxy-4'-isopropoxydiphenylsulfone
4-hydroxy-4'-n-propoxydiphenylsulfone
4-hydroxy-4'-n-butyloxydiphenylsulfone
<4-hydroxyphenylarylsulfonate Type>
4-hydroxyphenylbenzenesulfonate
4-hydroxyphenyl-p-tolylsulfonate
4-hydroxyphenylmethylenesulfonate
4-hydroxyphenyl-p-chlorobenzenesulfonate
4-hydroxyphenyl-p-tert-butylbenzenesultonate
4-hydroxyphenyl-p-isopropoxybenzenesulfonate
4-hydroxyphenyl- 1'-naphthalenesulfonate
4-hydroxyphenyl-2'-naphthalenesulfonate
<1,3-di[2-(hydroxyphenyl)-2-propyl]benzene Type>
1,3-di[2-(4-hydroxyphenyl)-2-propyl]benzene
1,3-di [2-(4-hydroxy-3-alkylphenyl)-2-propyl]benzene 1,3-di [2-(2,4-dihydroxyphenyl)-2-propyl]benzene
1,3-di [2-(2-hydroxy-5-methylphenyl)-2-propyl]benzene
<Resorcinol Type>
1,3-dihydroxy-6(α,α-dimethylbenzyl)-benzene.
<4-hydroxybenzoyloxybenzoic Acid Ester Type>
4-hydroxybenzoyloxybenzyl benzoate
4-hydroxybenzoyloxymethyl benzoate
4-hydroxybenzoyloxyethyl benzoate
4-hydroxybenzoyloxypropyl benzoate
4-hydroxybenzoyloxybutyl benzoate
4-hydroxybenzoyloxyisopropyl benzoate
4-hydroxybenzoyloxytert-butyl benzoate
4-hydroxybenzoyloxyhexyl benzoate
4-hydroxybenzoyloxyoctyl benzoate
4-hydroxybenzoyloxynonyl benzoate
4-hydroxybenzoyloxycyclohexyl benzoate
4-hydroxybenzoyloxy β-phenethyl benzoate
4-hydroxybenzoyloxyphenyl benzoate
4-hydroxybenzoyloxy α-naphthyl benzoate
4-hydroxybenzoyloxy β-naphthyl benzoate
4-hydroxybenzoyloxysec-butyl benzoate
<Bisphenolsulfone Type (I)>
bis-(3-1-butyl-4-hydroxy-6-methylphenyl)sulfone
bis-(3-ethyl-4-hydroxyphenyl)sulfone
bis-(3-propyl-4-hydroxyphenyl)sulfone
bis-(3-methyl-4-hydroxyphenyl)sulfone
bis-(2-isopropyl-4-hydroxyphenyl)sulfone
bis-(2-ethyl-4-hydroxyphenyl)sulfone
bis-(3-chloro-4-hydroxyphenyl)sulfone
bis-(2,3-dimethyl-4-hydroxyphenyl)sulfone
bis-(2,5-dimethyl-4-hydroxyphenyl)sulfone
bis-(3-methoxy-4-hydroxyphenyl)sulfone
4-hydroxyphenyl-2'-ethyl-4'-hydroxyphenylsulfone
4-hydroxyphenyl-2'-isopropyl-4'-hydroxyphenylsulfone
4-hydroxyphenyl-3'-isopropyl-4'-hydroxyphenylsulfone
4-hydroxyphenyl-3'-sec-butyl-4'-hydroxyphenylsulfone
3-chloro-4-hydroxyphenyl-3'-isopropyl-4'-hydroxyphenylsulfone
2-hydroxy-5-t-butylphenyl-4'-hydroxyphenylsulfone
2-hydroxy-5-t-aminophenyl-4'-hydroxyphenylsulfone
2-hydroxy-5-t-isopropylphenyl-4'-hydroxyphenylsulfone
2-hydroxy-5-t-octylphenyl-4'-hydroxyphenylsulfone
2-hydroxy-5-t-butylphenyl-3'-chloro-4'-hydroxyphenylsulfone
2-hydroxy-5-t-butylphenyl-3'-methyl-4'-hydroxyphenylsulfone
2-hydroxy-5-t-butylphenyl-3'-isopropyl-4'-hydroxyphenylsulfone
2-hydroxy-5-t-butylphenyl-2'-methyl-4'-hydroxyphenylsulfone
<Bisphenolsulfone Type (II)>
4,4'-sulfonyldiphenol
2,4'-sulfonyldiphenol
3,3'-dichloro-4,4'-sulfonyldiphenol
3,3'-dibromo-4,4'-sulfonyldiphenol
3,3',5,5'-tetrabromo-4,4'-sulfonyldiphenol
3,3'-diamino-4,4'-sulfonyldiphenol
<Others>
p-tert-butylphenol
2,4-dihydroxybenzophenone
novolac type phenolic resin
4-hydroxyacetophenone
p-phenylphenol
benzyl-4-hydroxyphenyl acetate
p-benzylphenol
4,4'-bis(p-tolylsulfonylaminocarbonilamino) diphenylmethane
4,4'-bis(phenylaminotiocarbonylamino) diphenylsufido aminobenzenesulfoamide derivatives of Japanese Patent Laid Open Publication 8-59603 diphenylsulfone bridged type compound of W097/16420

Further, metallic chelete type color developing components composed by higher fatty acid metal complex salt and polyhydric hydroxy.aromatic compound disclosed in Japanese Patent Laid Open Publication 10-258577 can be used.

In this invention, a conventional well known sensitizer can be used in the limitation in which the desired effect of this invention is not prevented. As an example of the sensitizer,
stearic acid amide,
palmitic acid amide,
methoxycarbonyl-N-benzamidestearate,
N-benzoyl stearic acid amide,
N-icosenic acid amide,
ethylene-bis-stearic acid amide,
behenic acid amide,
methylene-bis-stearic acid amide,
methylolamide,
N-methylolsteric acid amide,
dibenzyl terephthalate,
dimethyl terephthalate,
dioctyl terephthalate,
p-benzyloxybenzylbenzoate,
1-hydroxy-2-phenylnaphthoate,
dibenzyloxalate
di-p-methylbenzyloxalate,
di-p-chlorobenzyloxalate,
2-naphthylbenzylether,
m-tarphenyl,
p-benzylbiphenyl,
4-biphenyl-p-tolylether,
di(p-methoxyphenoxyethyl)ether,
1,2-di(3-methylphenoxy)ethane,
1,2-di(4-methylphenoxy)ethane,
1,2-di(4-methoxyphenoxy)ethane,
1,2-di(4-chlorophenoxy)ethane,
1,2-diphenoxyethane,
1-(4-methoxyphenoxy)-2-(2-methylphenoxy) ethane,
p-methylthiophenylbenzylether,
1,4-di(phenylthio)buthane,
p-acetotoluidide,
p-acetophenetidide,
N-acetoacetyl-p-toluidine,
di-(β-biphenylethoxy)benzene,
p-di(vinyloxyethoxy)benzene,
1-isopropylphenyl-2-phenylethane
1,2-bis(phenoxymethyl)benzene
p-toluenesulfonamide,
o-toluenesulfonamide,
di-p-tolylcarbonate and
phenyl-αnaphtylcarbonate can be mentioned, however is not intended to be limited to these compounds.

These sensitizer can be used alone or by mixing more than two kinds of them.

In the present invention, it is possible to prepare an over coating layer composed of polymer substance on a thermally sensitive recording layer for the purpose to improve the image preservative ability and the resistance to friction. Usually, since the revenue stamp adaptability is deteriorated by preparing the over coating layer, it is desirable to contain 1.5–10 weight % of polyvinyl alcohol whose degree of polymerization is bigger than 450 and degree of saponification is smaller than 90% or denatured polyvinyl alcohol to the total solid amount of the over coating layer same as to the preparation of a middle layer and a thermally sensitive recording layer.

Further, in a thermally sensitive recording layer, an ultraviolet ray absorbing agent such as benzophenon type or triazol type, a dispersing agent, a defoamer, an anti oxidation agent or a fluorescent dye can be used.

As a substrate, paper, recycled paper, synthetic paper, plastic film, plastic foam film, non-woven cloth, metal foil or complex sheet composed of these substances can be used.

The amount of color developer and basic dye, the kind and amount of other additives to be used to the thermally sensitive recording layer of this invention are decided according to the required quality and recording feature, and not restricted. However, in general, it is preferable to use 0.1–2 parts of basic dye, 0.5–4 parts of filler and 0.05–2 parts of stabilizer and sensitizer to 1 part of organic color developer, and adequate amount of binder is 5–25% to the total amount of solid.

Said color developer, dye and other additives that are added at need are ground to the fine particles smaller than several microns diameter by means of a grinder such as a ball mill, an attriter or a sand grinder, or by means of an adequate emulsifying apparatus, then binder and other additives are added at need, thus the coating is prepared. As the method to coat, a coating by hand, a size press coating method, a roll coater method, an air knife coating method, a blade coater method, a flow coater method, a comma direct method, a gravure direct method, a gravure reverse method and a reverse-roll coater method can be mentioned. Further, it is possible to be dried after sprayed, blown or soaked.

EXAMPLE

Preparation of Thermally Sensitive Recording Paper

The thermally sensitive recording paper of this invention will be illustrated more concretely by Examples, however, not intended to be limited to them. In the Examples and Comparative Examples, a term of "parts" indicates weight part or weight %.

Example 1

Preparation of a Coating for a Middle Layer 3.1 parts of 48% SBR latex emulsion and 7 parts of 10% aqueous solution of polyvinyl alcohol whose degree of polymerization is 2000 and degree of saponification is 80% (commodity name:PVA-420, product of Kuraray Co., Ltd.) are added to 25 parts of 40% dispersion of calcined kaoline and stirred, then a coating for a middle layer is obtained.

Preparation of a Coating for a Thermally Sensitive Recording Layer

Dispersions of color developer (A solution) and basic dye (B solution) are prepared separately by grinding to average particle diameter of 1 $\mu$m by a sand grinder.

A solution (dispersion of color developer)

| A solution (dispersion of color developer) | |
|---|---|
| 4-hydroxy-4'-isopropoxydiphenylsulfone (D-8) | 6.0 parts |
| 10% aqueous solution of polyvinyl alcohol | 18.8 parts |
| water | 11.2 parts |

-continued

| B solution (dispersion of basic dye) | |
|---|---|
| 3-dibutylamino-6-methyl-7-anilinofluoran (ODB-2) | 2.0 parts |
| 10% aqueous solution of polyvinyl alcohol | 4.6 parts |
| water | 2.6 parts |

Polyvinyl alcohol used in above mentioned dispersion is the polyvinyl alcohol whose degree of saponification is 88% around and degree of polymerization is 300 (commodity name: GL-03, product of Nihon Gosei Chemical Industries Co., Ltd.).

Then, dispersions are mixed together by the ratio mentioned below, stirred and the coating for a thermally sensitive recording layer is prepared.

| | |
|---|---|
| A solution (dispersion of color developer) | 36.0 parts |
| B solution (dispersion of basic dye [ODB-2]) | 9.2 parts |
| calcium carbonate (30% dispersion) | 20.0 parts |
| 100% saponificated polyvinyl alcohol (10%) | 9.0 parts |

Polyvinyl alcohol whose degree of saponification is almost 100% and whose degree of polymerization is 1700 (commodity name: PVA-117, product of Kuraray Co., Ltd) is used. And oil-absorbing amount of calcium carbonate is 110 ml/100 g.

Preparation of Thermally Sensitive Recording Paper

The obtained coating for middle layer is coated over the surface of 50 g/m$^2$ substrate paper and dried up so as to prepare the middle layer whose coating amount is 7.0 g/m$^2$. Then, the coating for thermally sensitive layer is coated over the middle layer so as to the coating amount be 6.0 g/m$^2$ and dried up. The obtained sheet is treated by a super calendar and the thermally sensitive recording paper of 500 sec smoothness is obtained.

Example 2

By same process to Example 1 a thermally sensitive recording paper is prepared in Example 2. However, at the preparation of a coating for middle layer, cup shape polymer particle (commodity name : V-1005, product of Nihon Zeon Co., Ltd.) disclosed in Japanese Patent Laid Open Publication 10-218950 is used as a pigment instead of calcined kaolin. The mixing ratio is follows.

| | |
|---|---|
| V-1005 (30%) | 33.3 parts |

Example 3. 4

By same process to Example 1 a thermally sensitive recording paper is prepared in Examples 3 and 4. However, at the preparation of a coating for middle layer, polyvinyl alcohol whose degree of saponification is 80% around and degree of polymerization is 1700 (commodity name:KH-17, product of Nihon Gosei Chemical Industries Co., Ltd.) is used in Example 3 and polyvinyl alcohol whose degree of saponification is 88% around and degree of polymerization is 1700 (commodity name:GH-17, product of Nihon Gosei Chemical Industries Co., Ltd.) is used in Example 4 instead of PVA-420.

| | |
|---|---|
| Example 3<br>KH-17 (10%) | 7 parts |
| Example 4<br>GH-17 (10%) | 7 parts |

Example 5

By same process to Example 1 a thermally sensitive recording paper is prepared in Example 5. However, at the preparation of a coating for thermally sensitive recording layer, PVA-420 is used instead of PVA-117. The mixing ratio of polyvinyl alcohol is mentioned below.

| Coating for thermally sensitive recording layer | |
|---|---|
| PVA-420 (10%) | 9.0 parts |

Example 6

By same process to Example 1 a thermally sensitive recording paper is prepared in Example 6. However, at the preparation of a coating for middle layer and a thermally sensitive recording layer, polyvinyl alcohol whose degree of saponification is 88% around and degree of polymerization is 500 (commodity name:GL-05, product of Nihon Gosei Chemical Industries Co., Ltd.) and polyvinyl alcohol whose degree of saponification is almost 100 % and degree of polymerization is 1700 (commodity name:PVA-117, product of Kuraray Co., Ltd) are used instead of PVA-420. The mixing ratios of polyvinyl alcohol of each coating are mentioned below.

| | |
|---|---|
| Coating for middle layer | |
| GL-05 (10%) | 3.5 parts |
| PVA-117 (10%) | 3.5 parts |
| Coating for thermally sensitive recording layer | |
| GL-05 (10%) | 4.5 parts |
| PVA-117 (10%) | 4.5 parts |

Example 7

By same process to Example 6 a thermally sensitive recording paper is prepared in Example 7. However, at the preparation of a coating for middle layer, polyvinyl alcohol whose degree of saponification is 80% around and degree of polymerization is 500 (commodity name:KL-05, product of Nihon Gosei Chemical Industries Co., Ltd.) instead of GL-05. The mixing ratios of polyvinyl alcohol are mentioned below.

| Coating for middle layer | |
|---|---|
| KL-05 (10%) | 3.5 parts |
| PVA-117 (10%) | 3.5 parts |

Example 8

By same process to Example 6 a thermally sensitive recording paper is prepared in Example 8. However, at the preparation of a coating for middle layer, PVA-420 is used instead of GL-05. The mixing ratio of polyvinyl alcohol is mentioned below.

| Coating for middle layer | |
|---|---|
| PVA-420 (10%) | 3.5 parts |
| PVA-117 (10%) | 3.5 parts |

Example 9

By same process to Example 6 a thermally sensitive recording paper is prepared in Example 9. However, at the preparation of a coating for middle layer, PVA-420 is used instead of GL-05 and PVA-117. The mixing ratio of polyvinyl alcohol is mentioned below.

| Coating for middle layer | |
|---|---|
| PVA-420 (10%) | 7.0 parts |

Example 10

By same process to Example 9 a thermally sensitive recording paper is prepared in Example 10. However, at the preparation of a coating for thermally sensitive recording layer, aluminum hydroxide whose oil-absorbing amount is 30 ml/100 g is used instead of calcium carbonate whose oil-absorbing amount is 110 ml/100 g. The mixing ratio is mentioned below.

Coating for thermally sensitive recording layer

| Coating for thermally sensitive recording layer | |
|---|---|
| aluminum hydroxide (50%) | 12.0 parts |

Example 11

By same process to Example 9 a thermally sensitive recording paper is prepared in Example 11. However, at the preparation of a coating for thermally sensitive recording layer, calcium carbonate whose oil-absorbing amount is 110 ml/100 g and aluminum hydroxide whose oil-absorbing amount is 30 mi/100 g are used as a filler. The mixing ratios are mentioned below. And the oil-absorbing amount of mixed filler is 70 ml/100 g.

| Coating for thermally sensitive recording layer | |
|---|---|
| calcium carbonate (30%) | 10.0 parts |
| aluminum hydroxide (50%) | 6.0 parts |

Examplel 12

By same process to Example 10 a thermally sensitive recording paper is prepared in Example 12. However, at the preparation of a coating for middle layer, GL-05 is used instead of PVA-420. The mixing ratio of polyvinyl alcohol is mentioned below.

| Coating for middle layer | |
|---|---|
| GL-05 (10%) | 1.2 parts |
| PVA-117 (10%) | 5.8 parts |

Examplel 13

By same process to Example 12 a thermally sensitive recording paper is prepared in Example 13. However, at the preparation of a coating for middle layer, mixing ratio of GL-05 and PVA-117 are changed. The changed mixing ratios are mentioned below.

| Coating for middle layer | |
|---|---|
| GL-05 (10%) | 2.5 parts |
| PVA-117 (10%) | 4.5 parts |

Examplel 14

By same process to Example 12 a thermally sensitive recording paper is prepared in Example 14. However, at the preparation of a coating for middle layer, mixing ratio of GL-05 and PVA-117 are changed. The changed mixing ratios are mentioned below.

| Coating for middle layer | |
|---|---|
| GL-05 (10%) | 21.0 parts |
| PVA-117 (10%) | 3.0 parts |

Example 15

By same process to Example 12 a thermally sensitive recording paper is prepared in Example 15. However, at the preparation of a coating for middle layer, mixing ratio of GL-05 and PVA-117 are changed. The changed mixing ratios are mentioned below.

| Coating for middle layer | |
|---|---|
| GL-05 (10%) | 38.0 parts |
| PVA-117 (10%) | 3.0 parts |

Example 16

By same process to Example 12 a thermally sensitive recording paper is prepared in Example 16. However, at the preparation of a coating for middle layer and thermally sensitive recording layer, mixing ratio of GL-05 and PVA-117 are changed. The changed mixing ratios are mentioned below.

| Coating for middle layer | |
|---|---|
| GL-05 (10%) | 3.5 parts |
| PVA-117 (10%) | 3.5 parts |

| Coating for thermally sensitive recording layer | |
|---|---|
| GL-05 (10%) | 1.7 parts |
| PVA-117 (10%) | 5.3 parts |

Examplel 17

By same process to Example 16 a thermally sensitive recording paper is prepared in Example 17. However, at the preparation of a coating for thermally sensitive recording layer, mixing ratio of GL-05 and PVA-117 are changed. The changed mixing ratios are mentioned below.

| Coating for thermally sensitive recording layer | |
|---|---|
| GL-05 (10%) | 3.5 parts |
| PVA-117 (10%) | 5.5 parts |

Examplel 18

By same process to Example 16 a thermally sensitive recording paper is prepared in Example 18. However, at the preparation of a coating for thermally sensitive recording layer, mixing ratio of GL-05 and PVA-117 are changed. The changed mixing ratios are mentioned below.

| Coating for thermally sensitive recording layer | |
|---|---|
| GL-05 (10%) | 18.0 parts |
| PVA-117 (10%) | 3.0 parts |

Example 19

By same process to Example 16 a thermally sensitive recording paper is prepared in Example 19. However, at the preparation of a coating for thermally sensitive recording layer, mixing ratio of GL-05 and PVA-117 are changed. The changed mixing ratios are mentioned below.

| Coating for thermally sensitive recording layer | |
|---|---|
| GL-05 (10%) | 29.0 parts |
| PVA-117 (10%) | 3.0 parts |

Comparative Example 1

By same process to Example 1 a thermally sensitive recording paper is prepared in Comparative Example 1. However, at the preparation of a coating for middle layer, PVA-117 is used instead of PVA-420. The mixing ration is mentioned below.

| Coating for middle layer | |
|---|---|
| PVA-117 (10%) | 7.0 parts |

Comparative Eample 2

By same process to Example 1 a thermally sensitive recording paper is prepared in Comparative Example 2. However, at the preparation of a coating for middle layer, GL-03 is used instead of PVA-420. The mixing ration is mentioned below.

| Coating for middle layer | |
|---|---|
| GL-03 (10%) | 7.0 parts |

Comparative Example 3

By same process to Example 6 a thermally sensitive recording paper is prepared in Comparative Example 3. However, at the preparation of a coating for middle layer, PVA-117 alone is used and GL-05 is not used.

| Coating for middle layer | |
|---|---|
| PVA-117 (10%) | 7.0 parts |

Evaluation of Thermally Sensitive Recording Feature

The printing test is carried out on the prepared thermally sensitive recording paper using TH-PMD (printing tester for thermally sensitive recording paper, a thermal head of Kyocera Co., Ltd. is installed) that is a product of Ohkura Denki Co., by 0.41 mJ/dot impressive energy. Image density of printing part is measured by means of a Macbeth densitometer (RD-914, amber filter is used).

Evaluation of a Revenue Stamp Adaptability

The revenue stamp adaptability of thermally sensitive recording paper is evaluated by afore-mentioned method. The evaluation test by this method is carried out on various kinds of revenue stamp or postage stamp, however, the difference is not clearly confirmed. Therefore, for the actual evaluation test of this invention, one yen postage stamp is used. The amount of water stuck to the surface of a stamp is adjusted to 5.5±1.5 mg using a sponge (MS-6 type, product of Shachihata Industries Co., Ltd.). A postage stamp to which water is stuck is adhered to the recording surface of a thermally sensitive recording paper, pressed by a weight of 500 g for 3 minutes, then is left for 30 minutes after the weight is removed. Then said thermally sensitive recording paper is hung up to an iron bar of 8 mm diameter and 30 cm length with the adhered postage stamp on an outer surface. To one end of said thermally sensitive recording paper a weight of 500 g is suspended using a fastening clip. While, the other end is held by hand and rub the portion where a postage stamp is adhered by cycle motion caused by pull down and put back action by hand. The cycle motion is carried out one time by every 2 seconds, and the number of cycles required to remove the postage stamp is measured. All procedures of above mentioned test are carried out in a condition of 20° C. temperature and 65% RH humidity.

Evaluation of Water Proof Feature

Evaluation of water proof feature is carried out by lightly rubbing the coating surface of prepared thermally sensitive recording paper with a wetted finger for three times. Evaluation is indicated as follows.

○: the coating layer is not removed.

×: the coating layer is removed

The obtained results are summarized in Table 1–3. In Table 1 and Table 2, the term of "contents" indicates the weight % of polyvinyl alcohol whose degree of polymerization is over 450 and degree of saponification is under 90% to the total amount of solid. In Table 2, kind of pigment for thermally sensitive layer, A : calcium carbonate, B : aluminium hydroxide

TABLE 1

| | middle layer PVA | | | |
|---|---|---|---|---|
| Example Co. Example | commodity name | degree of polymerization | degree of saponification | contents |
| Example 1 | PVA-420 | 2000 | 80 | 5.7% |
| Example 2 | PVA-420 | 2000 | 80 | 5.7% |
| Example 3 | KH-17 | 1700 | 80 | 5.7% |
| Example 4 | GH-17 | 1700 | 88 | 5.7% |
| Example 5 | PVA-420 | 2000 | 80 | 5.7% |
| Example 6 | GL-05/PVA-117 | 500/1700 | 88/100 | 2.9% |
| Example 7 | KL-05/PVA-117 | 500/1700 | 80/100 | 2.9% |
| Example 8 | PVA-420/PVA-117 | 2000/1700 | 80/100 | 2.9% |
| Example 9 | PVA-420 | 2000 | 80 | 5.7% |

TABLE 1-continued

| Example Co. Example | middle layer PVA commodity name | degree of polymerization | degree of saponification | contents |
|---|---|---|---|---|
| Example 10 | PVA-420 | 2000 | 80 | 5.7% |
| Example 11 | PVA-420 | 2000 | 80 | 5.7% |
| Example 12 | GL-05/PVA-117 | 500/1700 | 88/100 | 1.0% |
| Example 13 | GL-05/PVA-117 | 500/1700 | 88/100 | 2.1% |
| Example 14 | GL-05/PVA-117 | 500/1700 | 88/100 | 15.1% |
| Example 15 | GL-05/PVA-117 | 500/1700 | 88/100 | 24.4% |
| Example 16 | GL-05/PVA-117 | 500/1700 | 88/100 | 2.9% |
| Example 17 | GL-05/PVA-117 | 500/1700 | 88/100 | 2.9% |
| Example 18 | GL-05/PVA-117 | 500/1700 | 88/100 | 2.9% |
| Example 19 | GL-05/PVA-117 | 500/1700 | 88/100 | 2.9% |
| Co. Example 1 | PVA-117 | 1700 | 100 | 0% |
| Co. Example 2 | GL-03 | 300 | 88 | 0% |
| Co. Example 3 | PVA-117 | 1700 | 100 | 0% |

TABLE 2

| Example Co. Ex. | thermally sensitive recording layer PVA commodity name | degree of polymerization | degree of saponification | contents | thermally sensitive recording layer pigment type | oil absorbing amt. |
|---|---|---|---|---|---|---|
| Ex. 1 | PVA-117 | 1700 | 100 | 0% | A | 110 |
| Ex. 2 | PVA-117 | 1700 | 100 | 0% | A | 110 |
| Ex. 3 | PVA-117 | 1700 | 100 | 0% | A | 110 |
| Ex. 4 | PVA-117 | 1700 | 100 | 0% | A | 110 |
| Ex. 5 | PVA-420 | 2000 | 80 | 5.2% | A | 110 |
| Ex. 6 | GL-05/PVA-117 | 500/1700 | 88/100 | 2.6% | A | 110 |
| Ex. 7 | GL-05/PVA-117 | 500/1700 | 88/100 | 2.6% | A | 110 |
| Ex. 8 | GL-05/PVA-117 | 500/1700 | 88/100 | 2.6% | A | 110 |
| Ex. 9 | GL-05/PVA-117 | 500/1700 | 88/100 | 2.6% | A | 110 |
| Ex. 10 | GL-05/PVA-117 | 500/1700 | 88/100 | 2.6% | B | 30 |
| Ex. 11 | GL-05/PVA-117 | 500/1700 | 88/100 | 2.6% | A/B | 70 |
| Ex. 12 | GL-05/PVA-117 | 500/1700 | 88/100 | 2.6% | B | 30 |
| Ex. 13 | GL-05/PVA-117 | 500/1700 | 88/100 | 2.6% | B | 30 |
| Ex. 14 | GL-05/PVA-117 | 500/1700 | 88/100 | 2.6% | B | 30 |
| Ex. 15 | GL-05/PVA-117 | 500/1700 | 88/100 | 2.6% | B | 30 |
| Ex. 16 | GL-05/PVA-117 | 500/1700 | 88/100 | 1.0% | B | 30 |
| Ex. 17 | GL-05/PVA-117 | 500/1700 | 88/100 | 2.0% | B | 30 |
| Ex. 18 | GL-05/PVA-117 | 500/1700 | 88/100 | 9.8% | B | 30 |
| Ex. 19 | GL-05/PVA-117 | 500/1700 | 88/100 | 14.8% | B | 30 |
| Co. Ex. 1 | PVA-117 | 1700 | 100 | 0% | A | 110 |
| Co. Ex. 2 | PVA-117 | 1700 | 100 | 0% | A | 110 |
| Co. Ex. 3 | GL-05/PVA-117 | 500/1700 | 88/100 | 2.6% | A | 110 |

TABLE 3

| Example Co. Example | recording density | revenue stamp adaptability | water proof feature |
|---|---|---|---|
| Example 1 | 1.37 | 15 | ○ |
| Example 2 | 1.36 | 15 | ○ |
| Example 3 | 1.36 | 13 | ○ |
| Example 4 | 1.36 | 12 | ○ |
| Example 5 | 1.25 | over 50 | ○ |
| Example 6 | 1.33 | 20 | ○ |
| Example 7 | 1.33 | 22 | ○ |
| Example 8 | 1.34 | 24 | ○ |
| Example 9 | 1.30 | 27 | ○ |
| Example 10 | 1.30 | 40 | ○ |
| Example 11 | 1.32 | 35 | ○ |
| Example 12 | 1.35 | 10 | ○ |
| Example 13 | 1.35 | 13 | ○ |

TABLE 3-continued

| Example Co. Example | recording density | revenue stamp adaptability | water proof feature |
|---|---|---|---|
| Example 14 | 1.27 | 25 | ○ |
| Example 15 | 1.23 | 30 | X |
| Example 16 | 1.33 | 13 | ○ |
| Example 17 | 1.32 | 17 | ○ |
| Example 18 | 1.20 | 26 | ○ |
| Example 19 | 1.07 | 28 | X |
| Co. Example 1 | 1.37 | 1 | ○ |
| Co. Example 2 | 1.35 | 1 | X |
| Co. Example 3 | 1.31 | 2 | ○ |

As clearly understood from above mentioned results, the Examples 1–19 of the present invention show excellent results at the recording density, the revenue stamp adaptability and the waterproof feature. On the contrary, Comparative Examples 1 and 3, which do not use polyvinyl alcohol whose degree of saponification is under 90% in a middle layer, or Comparative Example 2, which uses polyvinyl alcohol, whose degree of saponification is under 90% but degree of polymerization is 300, sufficient revenue stamp adaptability can not be obtained.

Meanwhile, in cases of Examples 12 and 16, which use polyvinyl alcohol whose degree of polymerization is over 450 and whose degree of saponification is under 90% in a middle layer or a thermally sensitive recording layer but the amount of them to be used is small, it is difficult to obtain sufficient revenue stamp adaptability. Further, in the cases of Examples 15 and 19, the amount of polyvinyl alcohol to be used is slightly big, although sufficient revenue stamp adaptability can be obtained, water proof feature and thermally sensitive recording feature are slightly deteriorated. Therefore, it is effective for the preparation of thermally sensitive recording paper to use the polyvinyl alcohol whose degree of polymerization is over 450 and whose degree of saponification is under 90% in the adequate amount.

Further, the Examples 6–19 which use polyvinyl alcohol whose degree of polymerization is over 450 and whose degree of saponification is under 90% not only in a middle layer but also in a thermally sensitive recording layer show superior revenue stamp adaptability to Examples 1–4 which do not use said polyvinyl alcohol in a thermally sensitive recording layer. Namely, the use of said polyvinyl alcohol in both middle layer and thermally sensitive layer generates better effect. Furthermore, when Example 10 that uses filler whose oil absorbing amount is under 100 ml/100 g with Example 9 that uses filler whose oil absorbing amount is over 100 ml/100 g in a thermally sensitive recording layer, the revenue stamp adaptability of Example 10 is further improved.

The revenue stamp adaptability of thermally sensitive recording paper of this invention is improved without hurting thermally sensitive recording feature, and the strong adhering of revenue stamps to a thermally sensitive paper, which is concerned to be very difficult, becomes possible. Therefore, it is recognized as very important for the practical use.

What is claimed is:

1. A thermally sensitive recording paper, comprising:

a middle layer and a thermally sensitive color developing layer containing colorless or pale colored basic dye as a main component on a substrate, wherein said thermally sensitive color developing layer or said middle layer, or both said thermally sensitive color developing layer and said middle layer contains polyvinyl alcohol or denatured alcohol having a degree of polymerization larger than 450 and a degree of saponification smaller than 90%, having a recording surface which when a postage stamp or a revenue stamp is adhered to the recording surface requires at least ten cycles of a removal test procedure to remove at least one third of the adhered surface of the stamp from the recording surface of the thermally sensitive recording paper, wherein the removal test procedure comprises adhering the postage stamp or revenue stamp to the recording surface of the thermally sensitive recording paper, hanging the recording paper over an iron bar of about 8 mm diameter with the postage stamp or revenue stamp on an outer surface of the recording paper, adjusting the recording paper such that equal lengths are on either side of the iron bar, attaching to one end of the thermally sensitive recording paper a weight of about 500 g, holding the other end of the thermally sensitive recording paper by hand and carrying out a pull down and put back cycle motion of the hand to move the postage stamp or revenue stamp over the iron bar until at least a portion of the postage stamp or revenue stamp is removed from the surface of the recording paper.

2. The thermally sensitive recording paper of claim 1, wherein said polyvinyl alcohol or denatured polyvinyl alcohol is contained in an amount of 1.5 to 10 weight % of the total solid weight of the thermally sensitive color developing layer.

3. The thermally sensitive recording paper of claim 2, wherein the thermally sensitive recording layer contains a pigment whose oil absorbing amount is less than 100 m/100 g.

4. The thermally sensitive recording paper of claim 1 , wherein the thermally sensitive recording layer contains a pigment whose oil absorbing amount is less than 100 m/100 g.

* * * * *